US006120311A

United States Patent [19]

Wold et al.

[11] Patent Number: 6,120,311

[45] Date of Patent: Sep. 19, 2000

[54] POWER CORD THEFT-RESISTING DEVICE

[76] Inventors: Edwin L. Wold; Clifford J. Wold, both of P.O. Box 247, Alliance, Alberta, Canada, T0B 0A0

[21] Appl. No.: 09/309,880

[22] Filed: May 11, 1999

[51] Int. Cl.[7] ..... H01R 13/62

[52] U.S. Cl. ..... 439/304; 439/133; 70/14

[58] Field of Search ..... 439/133, 304, 439/371, 170; 70/14–18, 61, 57, 58, 30

[56] References Cited

U.S. PATENT DOCUMENTS 5,016,377 5/1991 Gunning ..... 42/70.11
5,154,072 10/1992 Leyden ..... 70/18
5,398,530 3/1995 Derman ..... 70/14
5,579,657 12/1996 Makous ..... 70/15
6,006,555 12/1999 Shu-Fen ..... 70/18

*Primary Examiner*—Khiem Nguyen
*Assistant Examiner*—Son V. Nguyen
*Attorney, Agent, or Firm*—Sean W. Goodwin

[57] ABSTRACT

Apparatus for securing an electrical power cord against theft comprises cylindrical tube rigidly attached to a padlock. The cord passes through the tube's bore. The bore is too small to pass the enlarged cord ends or plugs, trapping the cord in the tube. The cord cannot be removed without first removing the cord ends or severing the cord. The padlock can be locked to any secure structure, rendering the cord resistant to theft.

5 Claims, 2 Drawing Sheets

POWER CORD THEFT-RESISTING DEVICE

FIELD OF THE INVENTION

The present invention relates to a device for rendering electrical power cords more theft resistant.

BACKGROUND OF THE INVENTION

In climates with a cold season, it is conventional to equip automobile engines with a block heater for enabling easier starting at cold temperatures. The block heaters typically have a lead power cord which extends out of the hood of the car or hangs through the radiator grill. Usually an automobile owner uses an extension cord to extend between the lead power cord and a power source. The power source is usually an electrical outlet at home or at a parking lot.

Extension power cords are usually unattended overnight or even for days at a time. Further, they are nondescript, easy to conceal, may be stolen in seconds and are not damaged by theft.

There is therefore demonstrated a need for a simple, inexpensive means for increasing the difficulty of taking a cord and thereby reduce the incidence of extension cord theft.

SUMMARY OF THE INVENTION

The present invention is a device which renders an electrical power cord more resistant to theft by locking it to an existing structure.

In a broad aspect, a cord-locking device is provided comprising a member having a bore, preferably a cylindrical tube, which is rigidly attached to a security device, preferably a padlock. The tube's bore is large enough to pass the cross-section of the cord and is installed onto the cord. The bore is too small to pass the enlarged cord ends, typically plugs. Accordingly, the tube cannot be removed from the cord without first removing the cord ends or severing the cord. The padlock has a locking member, or shackle, which is operable between locked and unlocked positions for securing and releasing the padlock, tube and cord to the structure.

DETAILED DESCRIPTION OF THE PREFERRED EMBODIMENT

Figure 1:
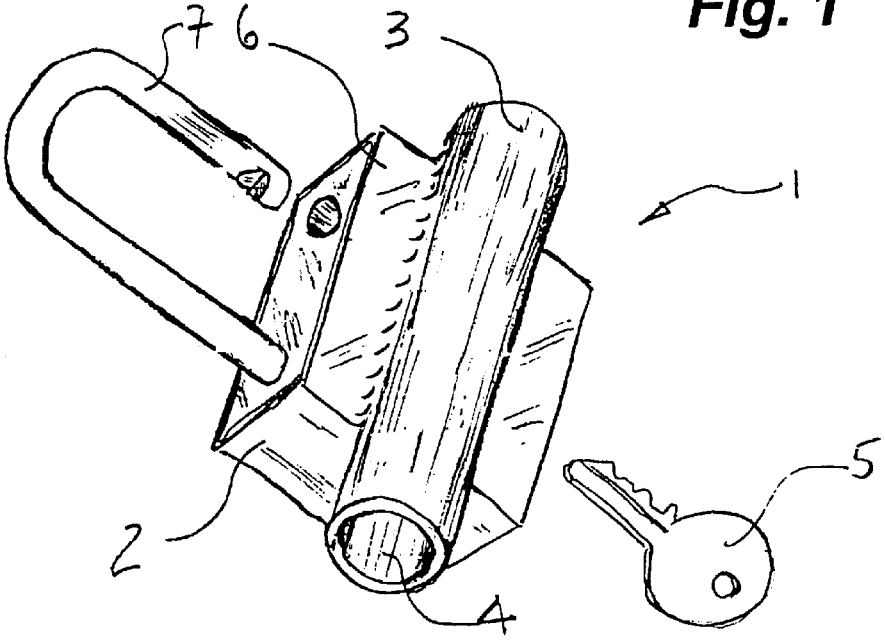
FIG. 1 is a perspective view of the electrical power cord-locking device in an unlocked position.

Having reference to FIG. 1, an electrical cord-locking device 1 is shown comprising a security device or padlock 2 integrated with an electrical power cord-encircling member or tube 3. The tube 3 has a bore 4. The padlock 2 is equipped with unlocking means such as a key 5.

The tube 3 is bonded or otherwise rigidly attached to the padlock 2. Preferably, the tube 3 is constructed of metal and is welded to a metal padlock 2.

Figure 2:
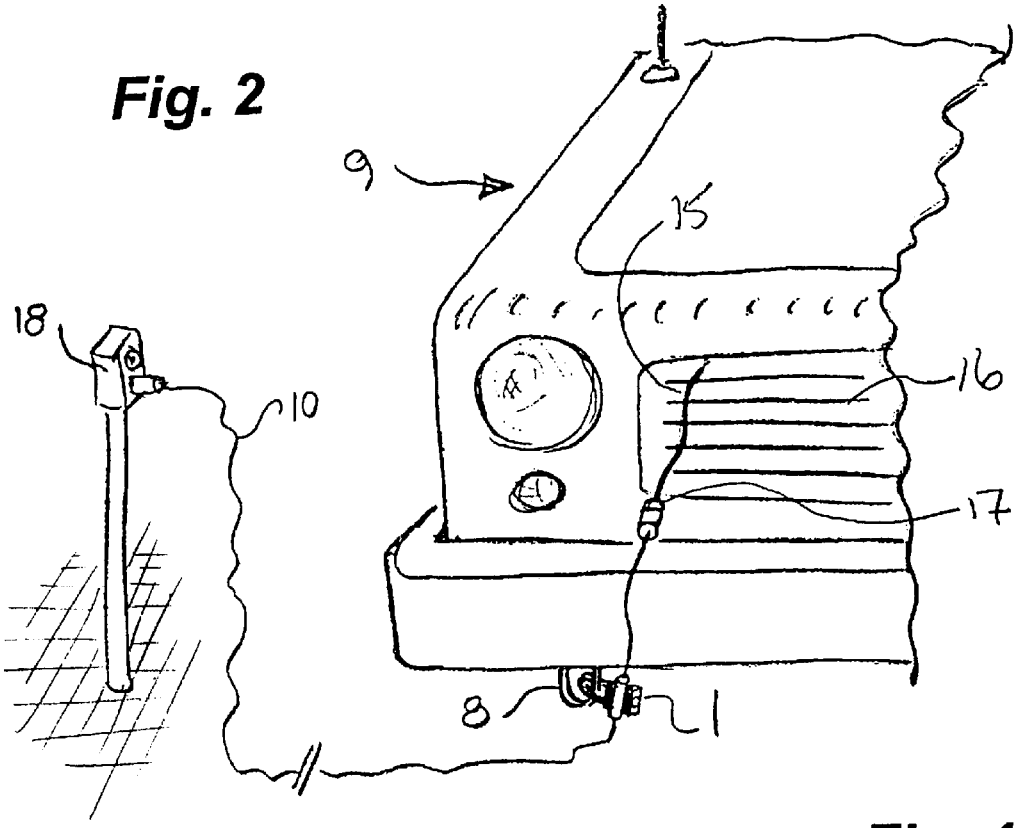
FIG. 2 is a partial perspective view of an automobile block heater lead cord passing through the cord-locking device of FIG. 1 and locked to the automobile's tow hook.

The padlock 3 has a body 6 and a U-shaped shackle 7. The shackle 7 is shown in the unlocked position for hooking onto a suitable structure, such as the tow hook 8 on an automobile 9 (FIG. 2). The shackle 7 is movable into a locked position (not shown) wherein the shackle is inserted into the body 6 for securing the padlock 2 and associated tube 3 to the tow hook 8.

Figure 3:
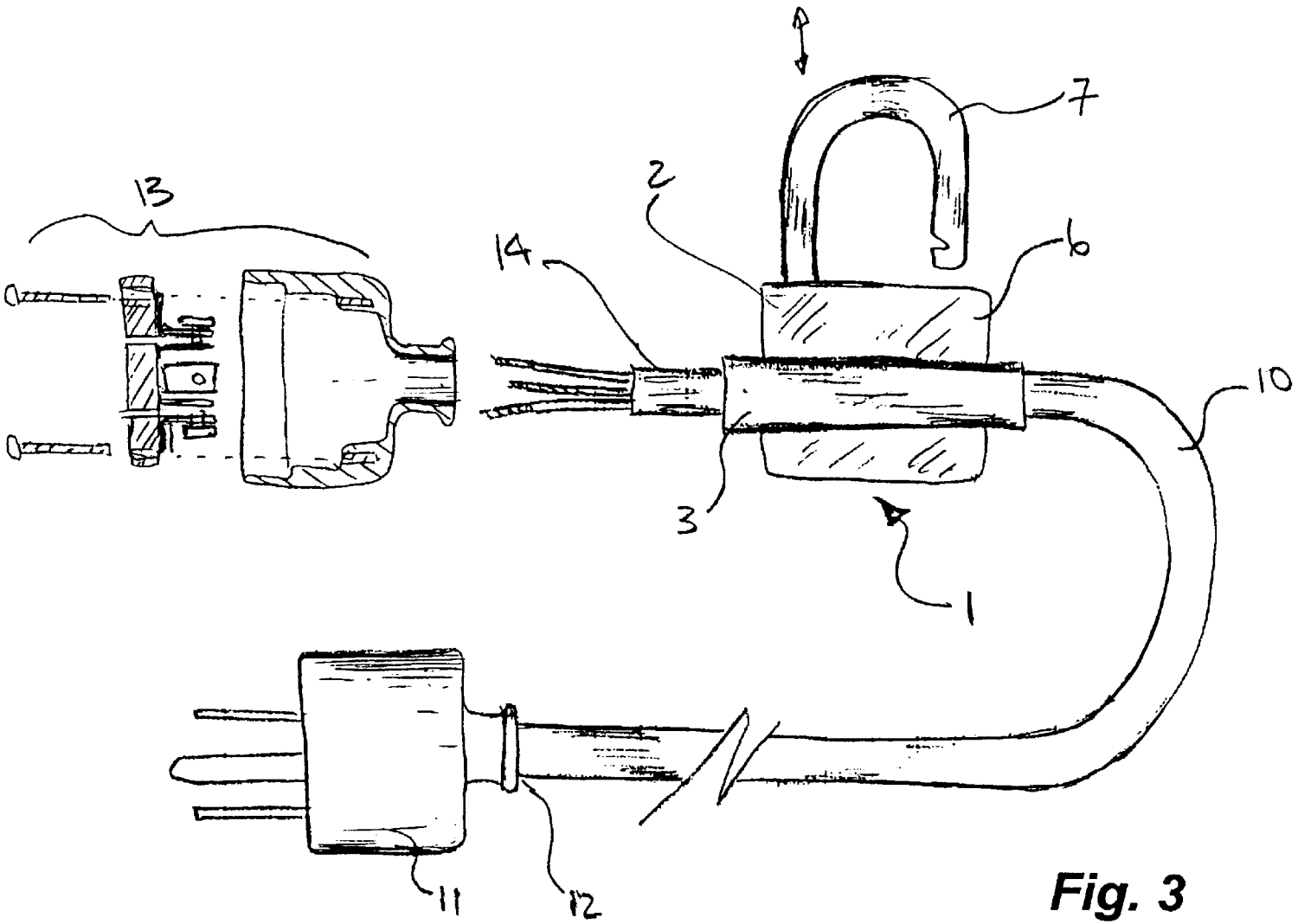
FIG. 3 is a view of a cord passing through the device of FIG. 1, showing one plug end disassembled to facilitate assembly.

Best shown in FIG. 3, in one embodiment, an electrical power cord 10 is provided having a male plug 11 at a source end 12 of the cord and a female plug 13 at the cord's output end 14. The cord 10 passes through the tube's bore 4. The male plug 11 is shown pre-assembled at the cord's source end 12. The female plug 13 is shown disassembled at the cord's output end 14.

In another embodiment (not shown), the cord has a male plug at the source end and is affixed to electrical equipment at the outlet end.

In both embodiments, the plugs 11,13 or equipment at the cords two ends 12,14 form a localized increase in the cross-section of the cord 10. Basically the ends of the cord are enlarged. Note that in all instances, the tube's bore 4 is too small permit the enlarged ends to pass therethrough, thus securing the cord 10 to the cord-locking device 1.

As shown in FIG. 3, at least one of the enlarged ends 13 must be attached to the cord 10 after the tube 3 is threaded over the cord 10. Only disassembly or removal of an enlarged end 11,13 or cutting of the cord 10 will free the cord from the cord-locking device 1.

The tube 3 is preferentially formed as an extended cylinder which adds to its strength and avoids point loads on the cord 10 passing therethrough.

Referring to FIG. 2, an automobile engine is fitted with a block heater (not shown) which has a lead power cord 15 extending through the grill 16 and is fitted with a male plug end 17. According to the first embodiment, a cord 10 (such as an extension cord) extends between the male plug end 11 engaging a power outlet 18 and the female plug end 13 engaging the heater's male plug end 17. A cord-locking device 1 of the present invention is installed with the cord 10 passing through the tube 3. The shackle 7 is secured to the tow hook 8 or other suitable portion of the automobile 9.

The present invention is inexpensive and simple to operate, yet is sufficient to resist or deter spontaneous acts of theft. A would-be thief would be required to use cutters or other tools, risking detection or damage of the cord.

The embodiments of the invention in which an exclusive property or privilege is claimed are defined as follows:

1. A device for locking an electrical power cord to a structure and rendering said cord theft-resistant, said cord having two enlarged ends comprising:

a member having a bore, said bore being large enough to pass a cross-section of the cord for installation therethrough, said bore being too small to pass the enlarged ends wherein the member can not be removed from the cord without first removing the enlarged ends or severing the cord; and a security device rigidly attached to said member and having a locking member which is operable between a first locked position for securing the security device, member, and cord to the structure to resist theft, and a second unlocked position for releasing the security device, member and cord from the structure to release the cord.

2. The cord-locking device as recited in claim 1 wherein the member comprises a tubular cylinder.

3. The cord-locking device as recited in claim 2 wherein the security device comprises a padlock.

4. The cord-locking device as recited in claim 3 wherein the enlarged ends of the cord comprise:

an electrically powered device; and a male electrical plug.

5. The cord-locking device as recited in claim 4 wherein the enlarged ends of the cord comprise:

a female electrical plug; and a male electrical plug.

* * * * *